US005751901A

United States Patent [19]

DeJaco et al.

[11] Patent Number: 5,751,901

[45] Date of Patent: May 12, 1998

[54] METHOD FOR SEARCHING AN EXCITATION CODEBOOK IN A CODE EXCITED LINEAR PREDICTION (CELP) CODER

[75] Inventors: Andrew P. DeJaco; Ning Bi, both of San Diego, Calif.

[73] Assignee: Qualcomm Incorporated, San Diego, Calif.

[21] Appl. No.: 690,709

[22] Filed: Jul. 31, 1996

[51] Int. Cl.[6] ..... G10L 3/02; G10L 5/02

[52] U.S. Cl. ..... 395/2.25; 395/228; 395/2.38; 395/2.77

[58] Field of Search ..... 395/2.25, 2.57, 395/2.26, 2.27, 2.28, 2.29, 2.38, 2.77, 2.35, 2.12, 2.2

[56] References Cited

U.S. PATENT DOCUMENTS

| | | | |
|---|---|---|---|
| Re. 32,580 | 1/1988 | Atal et al. | 381/40 |
| 3,633,107 | 1/1972 | Brady | 325/305 |
| 4,012,595 | 3/1977 | Ota | 179/15 |
| 4,076,958 | 2/1978 | Fulghum | 179/1.5 A |
| 4,214,125 | 7/1980 | Mozer et al. | 179/1 SM |
| 4,360,708 | 11/1982 | Taguchi et al. | 179/15.55 |
| 4,379,949 | 4/1983 | Chen et al. | 375/122 |
| 4,535,472 | 8/1985 | Tomcik | 381/31 |
| 4,610,022 | 9/1986 | Kitayama et al. | 381/36 |
| 4,617,676 | 10/1986 | Jayant et al. . | |
| 4,627,407 | 12/1986 | Schindler et al. | 395/2.92 |
| 4,667,340 | 5/1987 | Arjmand et al. | 395/2.16 |
| 4,672,669 | 6/1987 | DesBlache et al. | 381/46 |
| 4,672,670 | 6/1987 | Wang et al. | 381/47 |
| 4,677,671 | 6/1987 | Galand et al. | 381/31 |
| 4,696,192 | 9/1987 | Chen et al. | 381/31 |
| 4,697,261 | 9/1987 | Wang et al. . | |
| 4,726,037 | 2/1988 | Jayant | 375/27 |
| 4,771,465 | 9/1988 | Bronson et al. | 381/36 |
| 4,787,925 | 11/1988 | Lin | 381/36 |

(List continued on next page.)

OTHER PUBLICATIONS

Atal et al. "Adaptive Predictive Coding of Speech Signals", *The Bell System Technical Journal*, Oct. 1970, pp. 229–238.

Schroeder et al. Stochastic Coding of Speech Signals at Very Low Bit Rates: The Importance of Speech Perception, "*Speech Communication 4*" (1985) pp. 155–162.

Schroeder et al. "Code-excited Linear Prediction (CELP): High-quality Speech at Very Low Bit Rates," 1985 IEEE Communications, pp. 9370940(25.1.1–25.1.4).

Bishnu S. Atal. "Predictive Coding of Speech at Low Bit Rates", *IEEE Transactions on Communications*, vol. Com-30, No. 4, Apr. 1982, pp. 600–614.

Shinghai et al. "Improving Performance of Multi-Pulse LPC Coders at Low Bit Rates", *IEEE Transactions on Communications*, 1984, pp. 1.3.1–1.3.4.

Atal et al. "Stochastic Coding of Speech Signals at Very Low Bit Rates," 1984 IEEE, on a new stochastic model for generating speech signals suiteable for coding speech at a low bit rates.

Wang et al. "Phonetically—Based Vector Excitation Coding of Speech at 3.6 kbps," *1989 IEEE*, pp. 49–52.

Taniguchi et al, "Combined source coding based on multi-mode coding"; ICASSP 90: 1990 Inter. Conf. on Acoustics, Speech and Signal Processing; 3–6 Apr. 1990, pp. 447–480 vol. 1.

(List continued on next page.)

*Primary Examiner*—Allen R. MacDonald
*Assistant Examiner*—Scott Richardson
*Attorney, Agent, or Firm*—Russell B. Miller; Sean English

[57] ABSTRACT

A method for selecting a code vector in an algebraic codebook wherein the analysis window for the coder is extended beyond the length of the target speech frame. By extending the analysis window, the two dimensional impulse response matrix can be stored as a one dimensional autocorrelation matrix greatly saving on the computational complexity and memory required for the search.

9 Claims, 3 Drawing Sheets

U.S. PATENT DOCUMENTS

| | | | |
|---|---|---|---|
| 4,797,929 | 1/1989 | Gerson et al. | 381/43 |
| 4,817,157 | 3/1989 | Gerson | 381/40 |
| 4,827,517 | 5/1989 | Atal et al. | 381/41 |
| 4,831,636 | 5/1989 | Taniguchi et al. | 375/27 |
| 4,843,612 | 6/1989 | Brusch et al. | 375/1 |
| 4,850,022 | 7/1989 | Honda et al. | 381/36 |
| 4,852,179 | 7/1989 | Fette | 381/29 |
| 4,856,068 | 8/1989 | Quatieri, Jr. et al. | 381/47 |
| 4,864,561 | 9/1989 | Ashenfelter et al. | 370/81 |
| 4,864,620 | 9/1989 | Bialick | 395/2.27 X |
| 4,868,867 | 9/1989 | Davidson et al. | 381/36 |
| 4,885,790 | 12/1989 | Mcaulay et al. | 381/36 |
| 4,890,327 | 12/1989 | Bertland et al. | 381/38 |
| 4,896,361 | 1/1990 | Gerson | 381/40 |
| 4,899,384 | 2/1990 | Crouse et al. | 381/31 |
| 4,899,385 | 2/1990 | Ketchum et al. | 381/36 |
| 4,903,301 | 2/1990 | Kondo et al. | 395/2.1 |
| 4,905,288 | 2/1990 | Gerson et al. | 381/43 |
| 4,918,734 | 4/1990 | Muramatsu et al. | 381/46 |
| 4,933,957 | 6/1990 | Bottau et al. | 375/27 |
| 4,937,873 | 6/1990 | McAulay et al. | 381/51 |
| 4,965,789 | 10/1990 | Bottau et al. | 370/79 |
| 4,991,214 | 2/1991 | Freeman et al. | 381/38 |
| 5,007,092 | 4/1991 | Galand et al. | 381/36 |
| 5,023,910 | 6/1991 | Thomson | 381/37 |
| 5,054,072 | 10/1991 | McAulay et al. | 381/31 |
| 5,060,269 | 10/1991 | Zinser | 381/38 |
| 5,077,798 | 12/1991 | Ichikawa et al. | 381/36 |
| 5,091,945 | 2/1992 | Kleijn | 381/36 |
| 5,093,863 | 3/1992 | Galand | 381/38 |
| 5,103,459 | 4/1992 | Gilhousen et al. | 375/1 |
| 5,113,448 | 5/1992 | Nomura et al. | 381/47 |
| 5,140,638 | 8/1992 | Moulsley et al. | 381/36 |
| 5,159,611 | 10/1992 | Tomita et al. | 381/30 |
| 5,161,210 | 11/1992 | Druyvesteyn et al. | 395/2 |
| 5,175,769 | 12/1992 | Hejna, Jr. et al. | 395/2.2 |
| 5,187,745 | 2/1993 | Yip et al. | 381/36 |
| 5,202,953 | 4/1993 | Taguchi | 395/2 |
| 5,214,741 | 5/1993 | Akamine et al. | 392/2 |
| 5,222,189 | 6/1993 | Fielder | 395/2 |
| 5,235,671 | 8/1993 | Mazor | 395/2 |
| 5,327,498 | 7/1994 | Hamon | 395/2.77 |
| 5,357,594 | 10/1994 | Fielder | 395/2.38 X |
| 5,361,278 | 11/1994 | Vaupel et al. | 395/2.12 X |
| 5,384,811 | 1/1995 | Dickopp et al. | 395/2.12 |
| 5,444,816 | 8/1995 | Adoul | 395/2.28 |
| 5,524,172 | 6/1996 | Hamon | 395/2.77 |
| 5,596,675 | 1/1997 | Ishii et al. | 395/2.25 |
| 5,596,676 | 1/1997 | Swaminathan et al. | 395/2.77 X |
| 5,630,013 | 5/1997 | Suzuki et al. | 395/2.25 |
| 5,651,092 | 7/1997 | Ishii et al. | 395/2.35 |

OTHER PUBLICATIONS

Swaminathan et al., "Half Rate CELP codec candidate for north American digital cellular systems"; 1992 IEEE Inter conf. on Selected Topics Wireless communications; p. 192–194.

Taniguchi et al., "ADPCM with a multiquantizer for speech coding"; IEEE Journal on Selected Areas in Communications; Feb. 1988, p. 410–424, vol. 6 issue 2.

"DSP Chips can produce random numbers using proven algorithm"; By Paul Menner, *EDN*, pp. 141–145.

"Variable Rate Speech Coding: A Review" by N.S. Jayans, *1984 IEEE*.

"Varible Rate Speech Coding with onlinme segmentation and fast algebraic codes" By R. Di Francesco et al. *1990 IEEE*, pp. 233–236.

"Finite State CELP for Variable Rate Speech Coding" By Saeed V. Vaseghi, *1990 IEEE*, pp. 37–40.

"Variable Rate Speech Coding for Asynchronous Transfer Mode" by Hiroshi Nakada et al.. *1990 IEEE Transactions on Communications*, vol. 38, No. 3. Mar. 1990, pp. 277–284.

"A 4.8 KBPS code Excited Linear Predictive Coder" Bu Thomas E. Tremain et al. *Proceedings of the Mobile Satellite Conference, 1988.*

"Design and Performance of an Analysis–by–Synthesis class of Predictive Speech Coders" by Ricahrd C. Rose et al., Member IEEE; *1990 IEEE*; pp. 1489–1503.

"Digital Coding of Speech Waveforms: PCM, DPCM, and DM Quantizers" by Nuggehally S. Jayant, *1974 IEEE*, vol. 62 May 1974; pp. 611–632.

"Improvements of Background Sound Coding in Linear Predictive Speech Coders" By Torbjorn Wigren et al. 1995 IEEE, pp. 25–28.

"Fast Methods for the CELP Speech Coding Algorithm" *IEEE Transaction on Signal Processing vol. 38 No. 8*, Aug. 1990.

"The QCELP Variable Rate Vocoder" By William Gardner et al. Late 1991.

"Multiple Excitation Code Book Design and Fast Search Methods for CELP Speech Coding" by Forrest F. Tzeng, *1988 IEEE*, pp. 590–594.

"Variable Rate Adaptive predictive Filter" By Ioannis S. Dedes et al. *1992 IEEE* Transactions of Signal Processing, vol. 40 No. 3, pp. 511–517.

S. Vaseghi, PhD. "Speech Synthesis, Codina, Predictive Techniques".

"Multiple Exictation CodeBook Design and Fast Search Methods For CELP Speech Coding" by Forrest F. Tzeng, 1988 IEEE, pp. 590–594.

METHOD FOR SEARCHING AN EXCITATION CODEBOOK IN A CODE EXCITED LINEAR PREDICTION (CELP) CODER

BACKGROUND OF THE INVENTION

I. Field of the Invention

The present invention relates to speech processing. More particularly, the present invention relates to a novel and improved method and apparatus for locating an optimal excitation vector in a code excited linear prediction (CELP) coder.

II. Description of the Related Art

Transmission of voice by digital techniques has become widespread, particularly in long distance and digital radio telephone applications. This in turn has created interest in determining methods which minimize the amount of information sent over the transmission channel while maintaining high quality in the reconstructed speech. If speech is transmitted by simply sampling and digitizing, a data rate on the order of 64 kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices which employ techniques to compress voiced speech by extracting parameters that relate to a model of human speech generation are typically called vocoders. Such devices are composed of an encoder, which analyzes the incoming speech to extract the relevant parameters, and a decoder, which resynthesizes the speech using the parameters which it receives over the transmission channel. The model is constantly changing to accurately model the time varying speech signal. Thus, the speech is divided into blocks of time, or analysis frames, during which the parameters are calculated. The parameters are then updated for each new frame.

Of the various classes of speech coders, the Code Excited Linear Predictive Coding (CELP), Stochastic Coding, or Vector Excited Speech Coding coders are of one class. An example of a coding algorithm of this particular class is described in the paper "A 4.8 kbps Code Excited Linear Predictive Coder" by Thomas E. Tremain et al., *Proceedings of the Mobile Satellite Conference,* 1988. Similarly, examples of other vocoders of this type are detailed in U.S. Pat. No. 5,414,796, entitled "Variable Rate Vocoder" and assigned to the assignee of the present invention and incorporated by reference herein.

The function of the vocoder is to compress the digitized speech signal into a low bit rate signal by removing all of the natural redundancies inherent in speech. In a CELP coder, redundancies are removed by means of a short term formant (or LPC) filter. Once these redundancies are removed, the resulting residual signal can be modeled as white Gaussian noise, which also must be encoded.

The process of determining the coding parameters for a given frame of speech is as follows. First, the parameters of the LPC filter are determined by finding the filter coefficients which remove the short term redundancy, due to the vocal tract filtering, in the speech. Next, an excitation signal, which is input to LPC filter at the decoder, is chosen by driving the LPC filter with a number of random excitation waveforms in a codebook, and selecting the particular excitation waveform which causes the output of the LPC filter to be the closest approximation to the original speech. Thus, the transmitted parameters relate to (1) the LPC filter and (2) an identification of the codebook excitation vector.

A promising excitation codebook structure is referred to as an algebraic codebook. The actual structure of algebraic codebooks is well known in the art and is described in the paper "Fast CELP coding based on Algebraic Codes" by J. P. Adoul, et al., *Proceedings of ICASSP* Apr. 6–9, 1987. The use of algebraic codes is further disclosed in U.S. Pat. No. 5,444,816, entitled "Dynamic Codebook for Efficient Speech Coding Based on Algebraic Codes", the disclosure of which is incorporated by reference.

SUMMARY OF THE INVENTION

Analysis by synthesis based CELP coders use a minimum mean square error measure to match the best synthesized speech vector to the target speech vector. This measure is used to search the codevector codebook to choose the optimum vector for the current subframe. This mean square error measure is typically limited to the window over which the excitation codevector is being chosen and thus fails to account for the contribution this codevector will make on the next subframe being searched.

In the present invention, the window size over which the mean square error measure is minimized is extended to account for this ringing of the codevector in the current subframe into the next subframe. The window extension is equal to the length of the impulse response of the perceptual weighting filter, h(n). The mean square error approach in the current invention is analogous to the autocorrelation approach to the minimum mean square error used in LPC analysis as described in the paper "A 4.8 kbps Code Excited Linear Predictive Coder" by Thomas E. Tremain et al., *Proceedings of the Mobile Satellite Conference,* 1988.

Formulating the mean square error problem from this perspective, the present invention has the following advantages over the current approach:

1.) The ringing of the codevector from the current subframe to the next subframe is accounted for in the measure and thus pulses placed at the end of the vector are weighted equivalently to pulses placed at the beginning of the vector.

2.) The impulse response of the perceptual weighting filter becomes stationary for the entire subframe making the autocorrelation matrix of h(n), $\Phi(i,j)$, Toeplitz, or stated another way, $\Phi(i,j)=\Phi|i-j|$. Thus the present invention turns a 2-D matrix into a 1-D vector and thus reduces RAM requirements for the codebook search as well as computational operations.

BRIEF DESCRIPTION OF THE DRAWINGS

The features, objects, and advantages of the present invention will become more apparent from the detailed description set forth below when taken in conjunction with the drawings in which like reference characters identify correspondingly throughout and wherein.

DETAILED DESCRIPTION OF THE PREFERRED EMBODIMENTS

Figure 1:
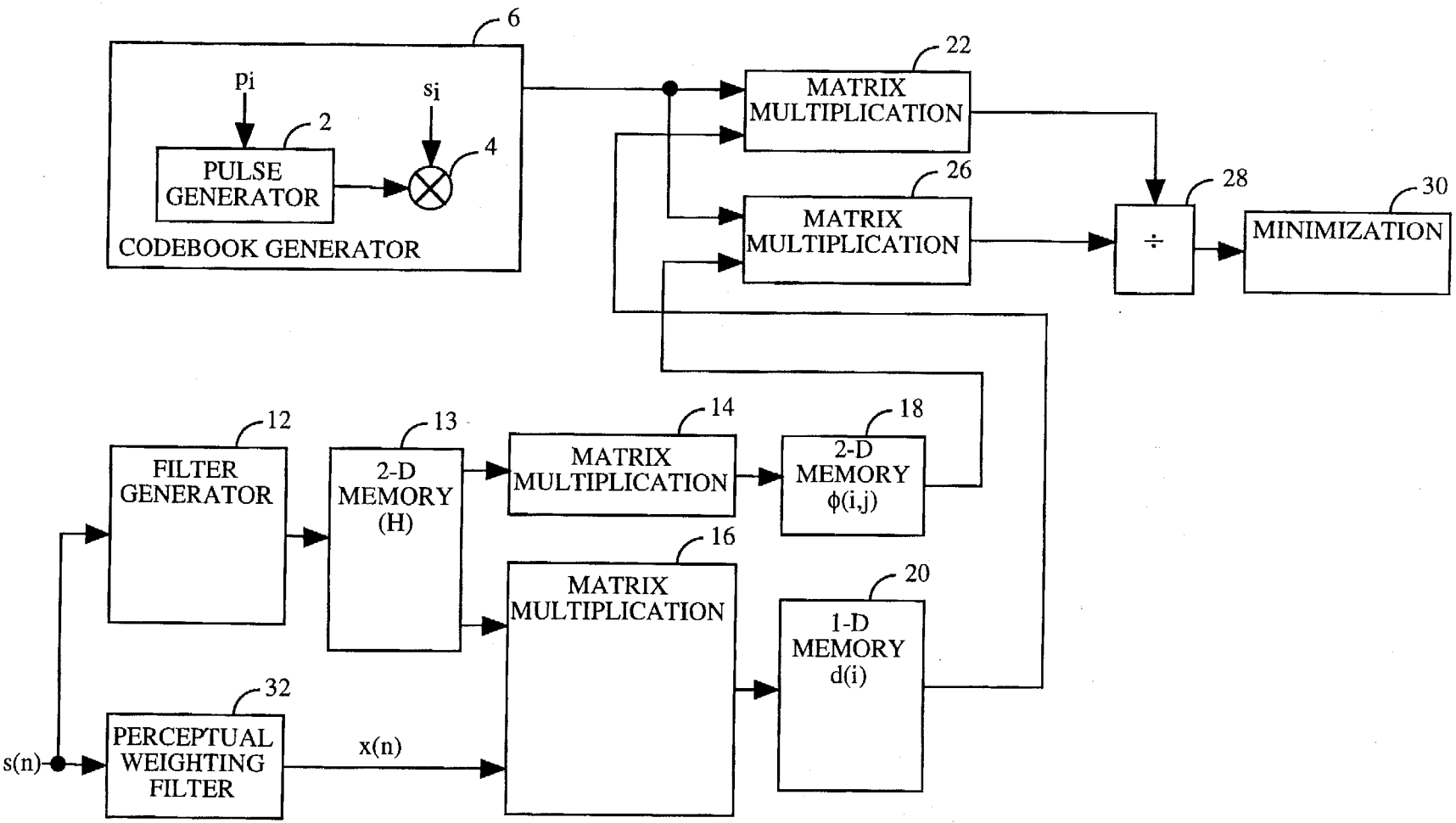
PRIOR ART FIG. 1
FIG. 1 is an illustration of the traditional apparatus for selecting a code vector in an ACELP coder.

FIG. 1 illustrates the traditional apparatus and method used to perform an algebraic codebook search. Codebook generator 6 includes a pulse generator 2 which in response to a pulse position signal, $p_i$, generates a signal with a unit pulse in the ith position. In the exemplary embodiment, the codebook excitation vector comprises forty samples and the possible positions for the unit impulse are divided into tracks T0 to T4 as shown in TABLE 1 below.

TABLE 1

| Track | Positions |
|---|---|
| T0 | 0, 5, 10, 15, 20, 25, 30, 35 |
| T1 | 1, 6, 11, 16, 21, 26, 31, 36 |
| T2 | 2, 7, 12, 17, 22, 27, 32, 37 |
| T3 | 3, 8, 13, 18, 23, 28, 33, 38 |
| T4 | 4, 9, 10, 19, 24, 29, 34, 39 |

In the exemplary embodiment, one pulse is provided for each track by pulse generator 2. $N_p$ is the number of pulses in an excitation vector. In the exemplary embodiment, $N_p$ is 5. For each pulse, $p_i$, a corresponding sign $s_i$ is assigned to the pulse. The sign of the pulse which is illustrated by multiplier 4 which multiplies the unit impulse at position, $p_i$, by the sign value, $s_i$. The resulting code vector, $c_k$, is given by equation (1) below.

$$c_k(j) = \sum_{i=0}^{N_p-1} s_i \cdot \delta(j - p_i) \tag{1}$$

Filter generator 12 generates the tap values for formant filter, h(n), as is well known in the art and described in detail in the aforementioned U.S. Pat. No. 5,414,796. Typically, the impulse function, h(n), would be computed for M samples where M is the length of the subframe being searched, for example 40.

The composite filter coefficients, h(n), are provided to and stored as two dimensional triangular Toeplitz matrix (H) in memory element 13 where the diagonal is h(0) and the lower diagonals are h(1) . . . , h(M−1) as shown below.

$$H = \begin{bmatrix} h(0) & 0 & 0 & \cdots & 0 \\ h(1) & h(0) & 0 & \cdots & 0 \\ h(2) & h(1) & h(0) & \cdots & 0 \\ \cdot & \cdot & \cdot & \cdot & \cdot \\ \cdot & \cdot & \cdot & \cdot & \cdot \\ \cdot & \cdot & \cdot & \cdot & \cdot \\ h(M-1) & h(M-2) & h(M-3) & \cdots & h(0) \end{bmatrix} \tag{2}$$

The values are provided by memory 13 to matrix multiplication element 14. H is then multiplied by its transpose to give the correlation of the impulse response matrix Φ in accordance with equation (3) below.

$$\Phi(i,j) = H^t \cdot H = \sum_{n=j}^{M} h(n-i)h(n-j), \text{ for } i \geqq j \tag{3}$$

The result of the correlation operation is then provided to memory element 18 and stored as a two dimensional matrix which requires $40^2$ or 1600 positions of memory for this embodiment.

The input speech frame s(n) is provided to and filtered by perceptual weighting filter 32 to provide the target signal, x(n). The design and implementation of perceptual weighting filter 32 is well known in the art and is described in detail in the aforementioned U.S. Pat. No. 5,414,796.

The sample values of the target signal, x(n), and values of the impulse matrix, H(n), are provided to matrix multiplication element 16 which computes the cross correlation between the target signal and the impulse response in accordance with equation (4) below.

$$d(i) = H^t \cdot x = \sum_{j=1}^{M} x(i)h(i-j), \text{ for } j = 0 \text{ to } M. \tag{4}$$

The values from memory element 20, d(i), and the codebook vector amplitude elements, $c_k$, are provided to matrix multiplication element 22 which multiplies the codebook vector amplitude elements by the vector d(n) and squares the resulting value in accordance with equation (5) below.

$$E_{xy}^2 = \left( \sum_{i=0}^{N_p-1} c_k(p_i) \cdot d(p_i) \right)^2 \tag{5}$$

Codebook vector amplitude elements, $c_k$, and codebook pulse positioning vector p are provided to matrix multiplication element 26. Matrix multiplication element 26 computes the value, $E_{yy}$, in accordance with equation (6) below.

$$Eyy = \sum_{i=0}^{N_p-1} \phi(p_i,p_j) + 2 \cdot \sum_{i=0}^{N_p-1} \sum_{j=i+1}^{N_p-1} c_k(p_i)c_k(p_j)\phi(p_i,p_j) \tag{6}$$

The values of $E_{yy}$ and $(E_{xy})^2$ are provided to divider 28, which computes the value $T_k$ in accordance with equation (7) below.

$$T_k = \frac{(E_{xy})^2}{E_{yy}} \tag{7}$$

The values $T_k$ for each codebook vector amplitude element, $c_k$, and codebook pulse positioning vector p are provided to minimization element 30 and the codebook vector that maximizes the value $T_k$ is selected.

Figure 2:
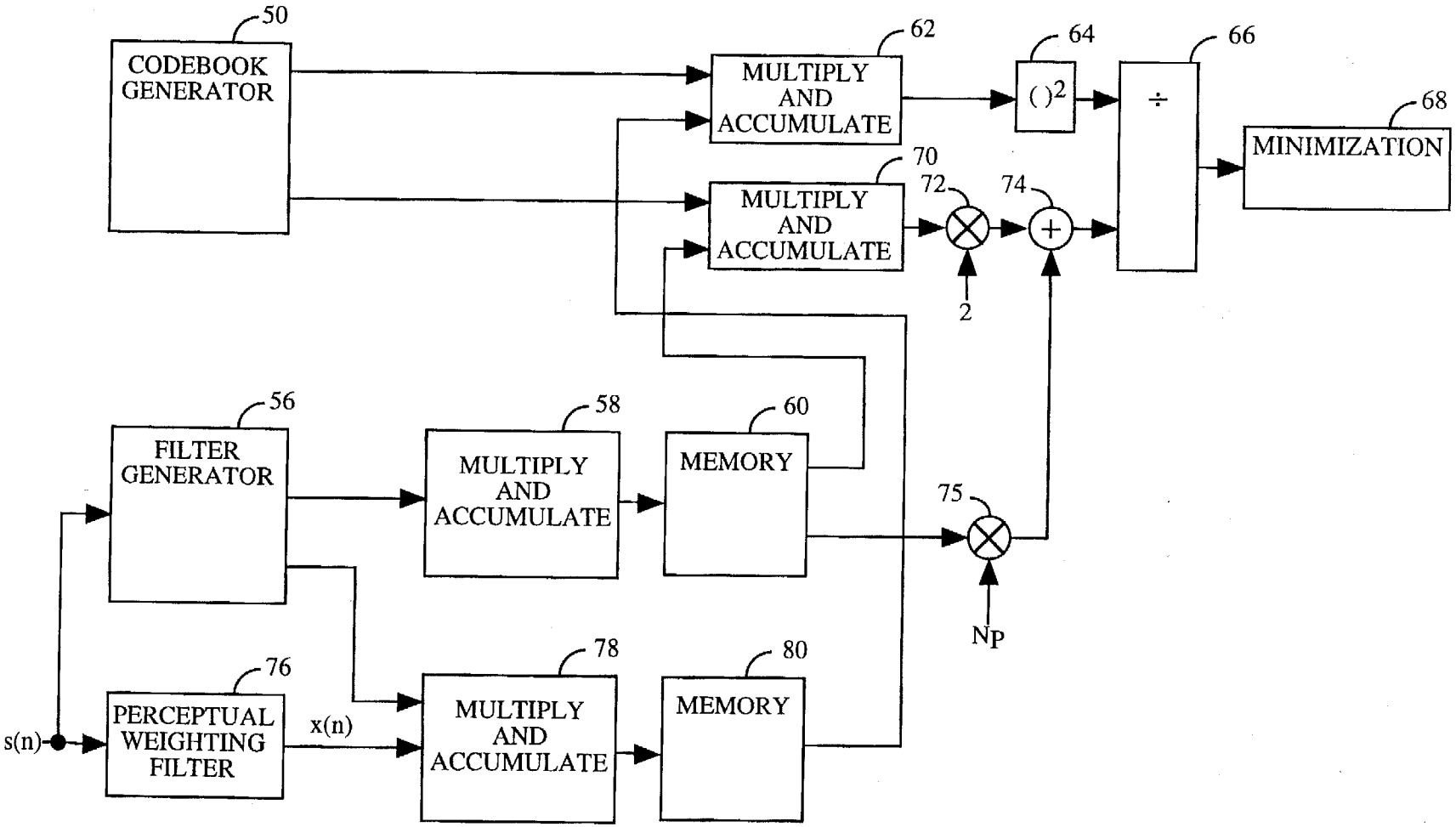
FIG. 2 is a block diagram of the apparatus of the present invention for selecting a code vector in an ACELP coder.
Figure 3:
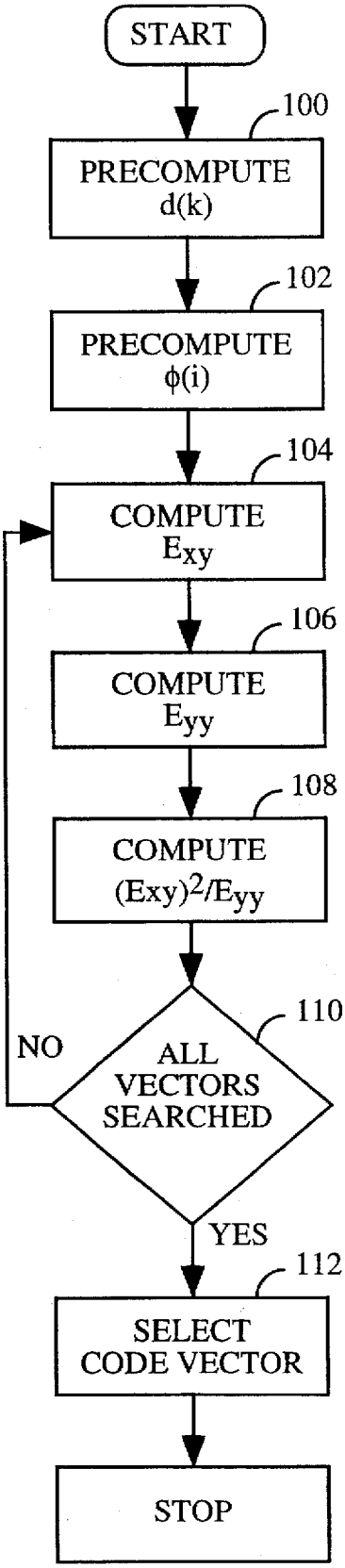
FIG. 3 is a flowchart describing the method for selecting a code vector n the present invention.

Referring to FIG. 2, the apparatus for selecting the code vector in the present invention is illustrated. In FIG. 3, a flowchart describing the operational flow of the present invention is illustrated. First in block 100, the present invention precomputes the values of d(k), which can be computed ahead of time and stored since its values do not change with the code vector being searched.

The speech frame, s(n) is provided to perceptual weighting filter 76 which generates the target signal, x(n). The resulting target speech segment, x(n), consists of M+L−1 perceptually weighted samples which are provided to multiply and accumulate element 78. L is the length of the impulse response of perceptual weighting filter 76. This extended length target speech vector, x(n), is created by filtering M samples of the speech signal through the perceptual weighting filter 76 and then continuing to let this filter ring out for L−1 additional samples while a zero input vector is applied as input to perceptual weighting filter 76.

As described previously with respect to filter generator 12, filter generator 56 computes the filter tap coefficients for the formant filter and from those coefficients determines the impulse response, h(n). However filter generator 56 generates a filter response for delays from 0 to L−1, where L is the length of the impulse response, h(n). It should be noted that though, described in the exemplary embodiment, without a pitch filter the present invention is equally applicable for cases where there is a pitch filter by simple modification of the impulse response as is well known in the art.

The values of h(n) from filter generator 56 are provided to multiply and accumulate element 78. Multiply and accumulate element 78 computes the cross correlation of the target sequence, x(n), with the filter impulse response, h(n), in accordance with equation (8) below.

$$d(n)=\sum_{j=n}^{n+L-1} x(n)h(n-j), \text{ for } n=0 \text{ to } M-1. \quad (8)$$

The computed values of d(n) are then stored in memory element 80.

In block 102, the present invention precomputes the values of Φ needed for the computation of $E_{yy}$. It is at this point where the biggest gain in memory savings of the present invention is realized. Because the mean square error measure has been extended over a larger window, h(n) is now stationary over the entire subframe and consequently the 2-D Φ(i,j) matrix becomes a 1-D vector because Φ(i,j) =Φ(|i−j|). In the present embodiment as described in Table 1, this means that the traditional method requires 1600 Ram locations while the present invention requires only 40. Operation count savings are also obtained in the computation and store of the 1-D vector over the 2-D matrix also. In the present invention, the values of Φ are computed in accordance with equation (9) below.

$$\Phi(i)=\sum_{n=0}^{L-1} h(n)h(n-i) \quad (9)$$

The values of Φ(i) are stored in memory element 80, which only requires L memory locations, as opposed to the traditional method which requires the storage of $M^2$ elements. In this embodiment, L=M.

In block 104, the present invention computes the cross correlation value $E_{xy}$. The values of d(k) stored in memory element 80 and the current codebook vector $c_i(k)$ from codebook generator 50 are provided to multiply and accumulate element 62. Multiply and accumulate element 62 computes the cross correlation of the target vector, x(k), and the codebook vector amplitude elements, $c_i(k)$ in accordance with equation (10).

$$E_{xy}=\sum_{k=0}^{N_p} c_i(p_k)\cdot d(p_k) \quad (10)$$

The value of $E_{xy}$ is then provided to squaring means 64 which computes the square of $E_{xy}$.

In block 106, the present invention computes the value of the autocorrelation of the synthesized speech, $E_{yy}$. The codebook vector amplitude elements $c_i(k)$ and $c_j(k)$ are provided from codebook generator 50 to multiply and accumulate element 70. In addition, the values of Φ|i−j| are provided to multiply and accumulate element 70 from memory element 60. Multiply and accumulate element 70 computes the value given in equation (11) below.

$$\sum_{i=0}^{N_p}\sum_{j=i+1}^{N_p} c_k(p_i)\cdot c_k(p_j)\cdot \Phi|p_i-p_j| \quad (11)$$

The value computed by multiply and accumulate means 70 is provided to multiplier 72 where its value is multiplied by 2. The product from multiplier 72 is provided to a first input of summer 74.

Memory element 60 provides the value of Φ(0) to multiplier 75 where it is multiplied by the value $N_p$. The product from multiplier 75 is provided to a second input of summer 74. The sum from summer 74 is the value Eyy which is given by equation (12) below.

$$E_{yy}=N_p\cdot\Phi(0)+2\cdot\sum_{i=0}^{N_p}\sum_{j=i+1}^{N_p} c_k(p_i)\cdot c_k(p_j)\cdot\Phi|p_i-p_j| \quad (12)$$

An appreciation of the savings of computational resource can be attained by comparing equation (12) of the present invention with equation (6) of the traditional search method. This savings results from faster addressing of a 1-D matrix (Φ|pi−pj|) over a 2-D access of Φ(pi,pj), from less adds required for Eyy computation (for the exemplary embodiment equation (6) takes 15 adds while equation (12) takes 11 assuming $c_k$(pi) are just 1 or −1 sign terms), and from the 1360 Ram location savings since Φ(i,j) does not need to be stored.

In block 108, the present invention computes the value of $(E_{xy})^2/E_{yy}$. The value of $E_{yy}$ from summing element 74 is provided to a first input of divider 66. The value of $(Exy)^2$ is provided from squaring means 64 is provided to the second input of divider 66. Divider 66 then computes the quotient given in equation (13) below.

$$\frac{E_{xy}^2}{E_{yy}} \quad (13)$$

The quotient value from divider 66 is provided to minimization element 66. In block 110, if the all vectors $c_k$ have not been tested the flow moves back to block 104 and the next code vector is tested as described above. If all vectors have been tested then, in block 112, minimization element 68 selects the code vector which results in the maximum value of $(E_{xy})^2/E_{yy}$.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. In a linear prediction coder to provide synthesized speech in which short term and long term redundancies by a filter means having L taps wherein said filter means has an impulse response, h(n), are removed from a frame of N digitized speech samples resulting in a residual waveform of N samples, a method for encoding said residual waveform using k codebook vector, $c_k$, comprising:

convolving a target signal, x(n), and said impulse response, h(n) to provide a first convolution;

autocorrelating an impulse response matrix wherein said impulse response matrix is a lower triangular toeplitz matrix with diagonal h(0) where h(0) is the zeroth impulse response value and the lower diagonals h(1), . . . ,h(L−1) and wherein said impulse response autcorrelation is computed in accordance with the equation:

$$\Phi(i)=\sum_{n=0}^{L-1} h(n)h(n-i);$$

autocorrelating said synthesized speech in accordance with said autocorrelation of said impulse response matrix and said codebook vectors, $c_k$ to provide a synthesized speech autocorrelation, $E_{yy}$;

cross correlating said synthesized speech and said target speech in accordance with said first convolution and said codebook vectors to provide a cross correlation $E_{xy}$; and selecting a codebook vector in accordance with said cross correlation, $E_{xy}$, and said synthesized speech autocorrelation, $E_{yy}$.

2. The method of claim 1 further comprising the steps of:

generating a first set of filter coefficients;

generating a second set of filter coefficients;

combining said first set of filter coefficients and said second set of filter coefficients to provide said impulse response, h(n).

3. The method of claim 1 further comprising:

receiving said input frame of N digitized samples; and perceptual weighting said input frame to provide said target signal.

4. The method of claim 1 wherein said step of convolving said target signal and said impulse response is performed in accordance with the equation:

$$d(n) = \sum_{j=n}^{n+L-1} x(n)h(n-j), \text{ for } n = 0 \text{ to } M-1.$$

5. The method of claim 1 further comprising the step of storing said impulse response autcorrelation in a memory of L memory locations.

6. The method of claim 1 wherein said step of cross correlating said synthesized speech and said target speech is performed in accordance with the equation:

$$E_{xy} = \sum_{k=0}^{N_p} c_i(p_k) \cdot d(p_k),$$

where d(k) is the cross correlation of the target signal and the impulse response.

7. The method of claim 1 wherein step of autocorrelating said synthesized speech is performed in accordance with the equation:

$$E_{yy} = N_p \cdot \Phi(0) + 2 \cdot \sum_{i=0}^{N_p} \sum_{j=i+1}^{N_p} c_k(p_i) \cdot c_k(p_j) \cdot \Phi|p_i - p_j|.$$

8. The method of claim 1 wherein said step of selecting a codebook vector comprises the steps of:

for each code vector, $c_k$, squaring the value Exy;

dividing computed value of $E_{yy}$ by said square of $E_{xy}$ for each code vector, $c_k$; and selecting the code vector which maximizes the quotient of $E_{yy}$ and the square of $E_{xy}$.

9. The method of claim 1 wherein said codebook vectors, $c_k$, are selected in accordance with an algebraic codebook format.

* * * * *